US006105965A

United States Patent [19]

Perry

[11] Patent Number: 6,105,965

[45] Date of Patent: Aug. 22, 2000

[54] MAGNETIC TOSS GAME METHOD AND APPARATUS

[76] Inventor: Michael C. Perry, 136 S. Euclid, Oak Park, Ill. 60302

[21] Appl. No.: 09/117,977

[22] PCT Filed: Feb. 13, 1997

[86] PCT No.: PCT/US97/02112

§ 371 Date: Aug. 11, 1998

§ 102(e) Date: Aug. 11, 1998

[87] PCT Pub. No.: WO97/29812

PCT Pub. Date: Aug. 21, 1997

Related U.S. Application Data

[60] Provisional application No. 60/011,775, Feb. 13, 1996, and provisional application No. 60/018,363, May 16, 1996.

[51] Int. Cl.[7] ..... A63B 65/02

[52] U.S. Cl. ..... 273/348.3; 473/570

[58] Field of Search ..... 273/348.3; 473/570

[56] References Cited

U.S. PATENT DOCUMENTS

| | | | |
|---|---|---|---|
| 2,641,793 | 6/1953 | Wilm | 273/348.3 |
| 3,026,110 | 3/1962 | Hess et al. | 473/570 |
| 3,170,693 | 2/1965 | Felsher | 473/348.3 |
| 3,176,989 | 4/1965 | Harrison et al. | 473/570 |
| 4,055,343 | 10/1977 | Stuart | 473/348.3 |
| 4,119,316 | 10/1978 | Kettlestrings | 473/570 |

*Primary Examiner*—Mark S. Graham
*Attorney, Agent, or Firm*—Owen E. Perry

[57] ABSTRACT

A spinning-type game piece that can be tossed at, and secured to, a magnetically attractive game surface. The game piece includes an aerodynamic body of thin sheet material with a base portion and at least one rotor. A magnetic substrate is secured to an underside of the base portion.

28 Claims, 3 Drawing Sheets

FIG-1
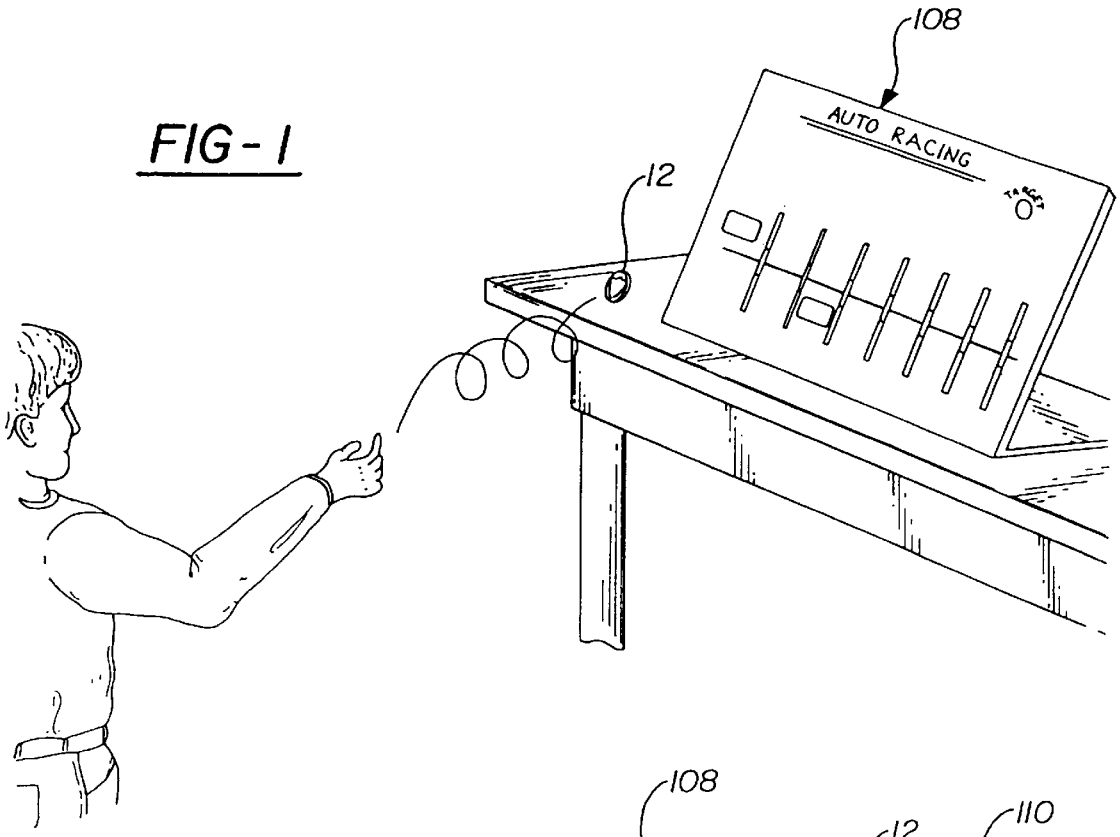
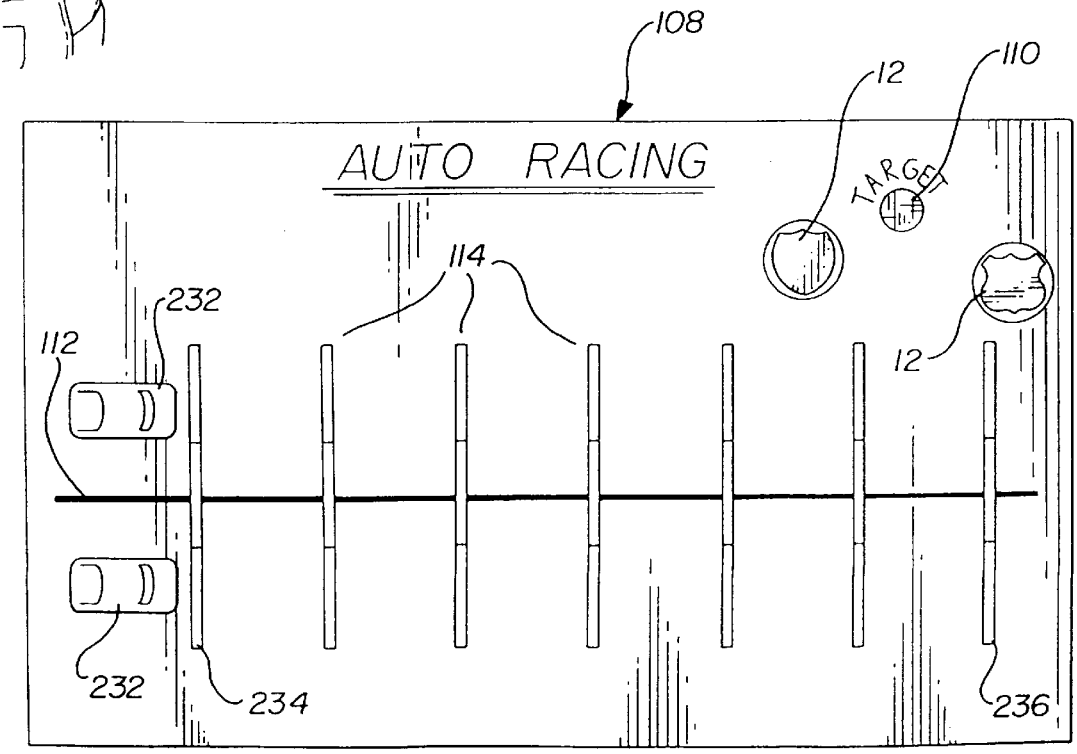
FIG-2

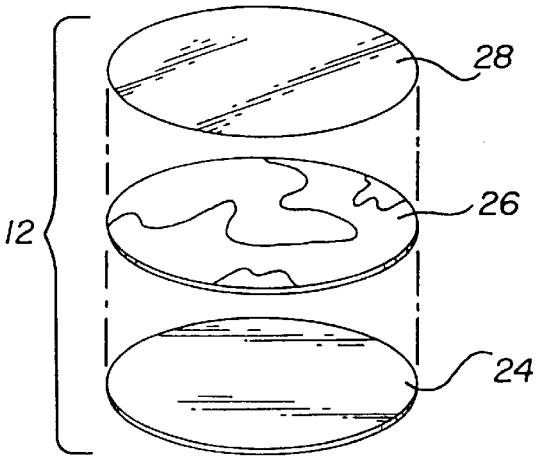
FIG - 3
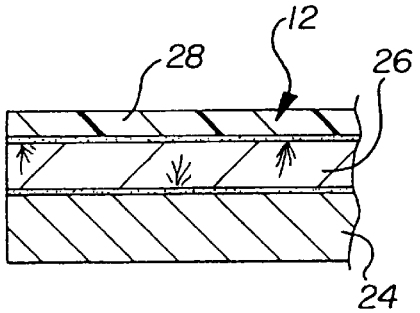
FIG - 4
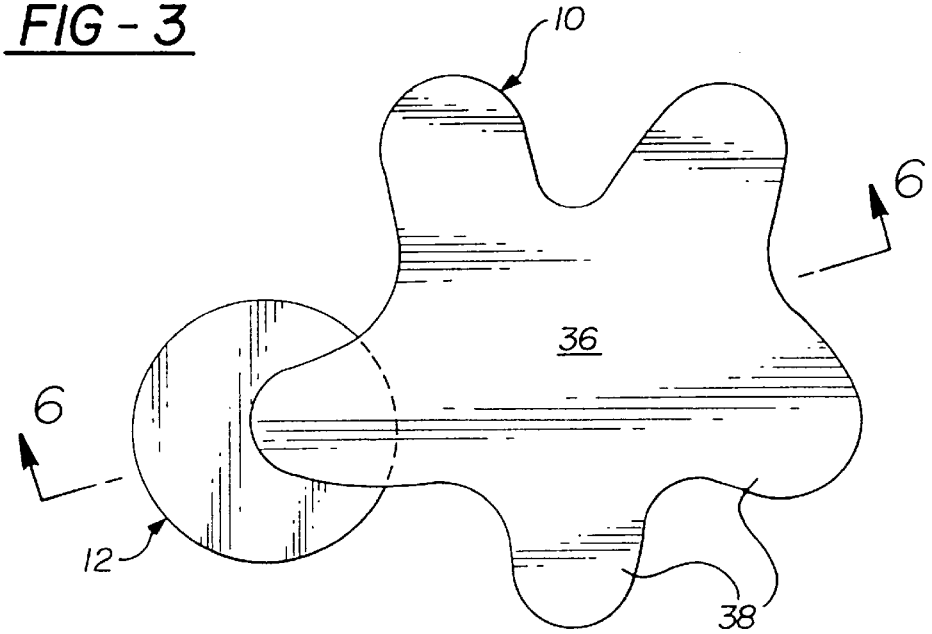
FIG - 5
FIG - 6
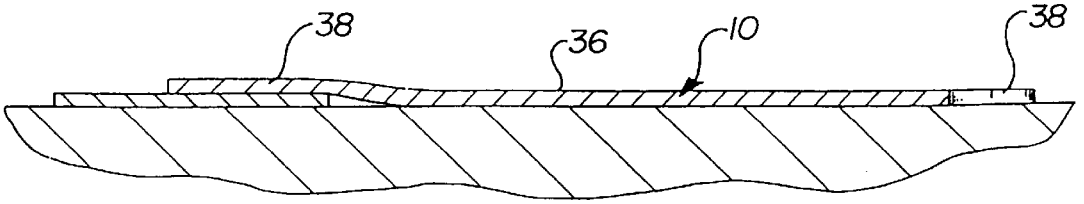

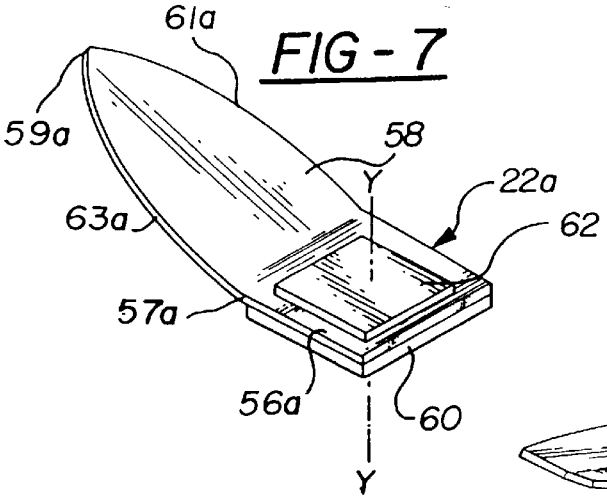
FIG - 7
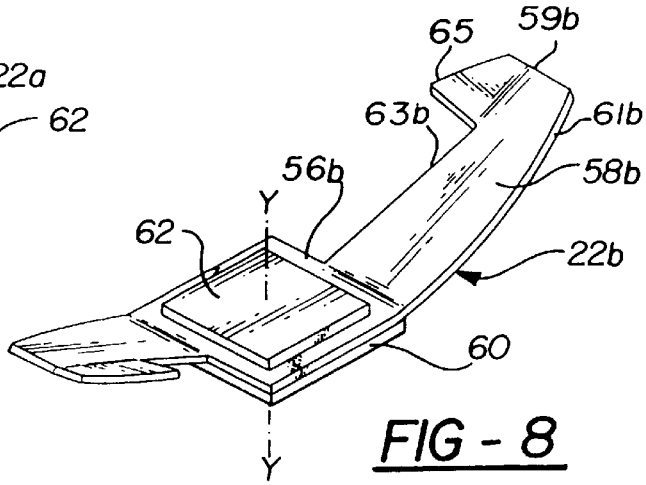
FIG - 8
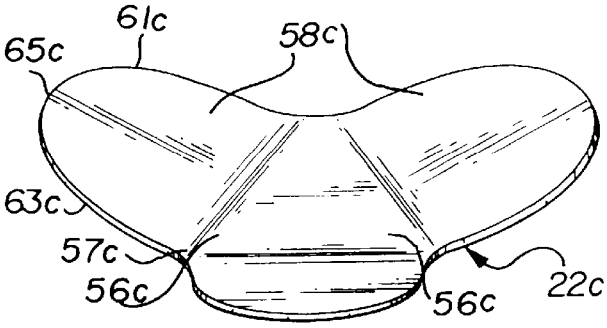
FIG - 9
FIG - 10
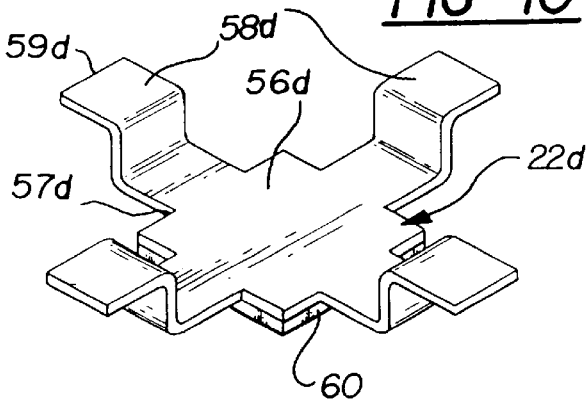

MAGNETIC TOSS GAME METHOD AND APPARATUS

This application claims benefit of Provisional Appl. 60/011,775 filed Feb. 13, 1996 and Provisional Appl. 60/018,363 filed May 16, 1996.

TECHNICAL FIELD

This invention relates to a game boards and game pieces of magnetic material and magnetically attractive material, and various methods for using the boards and pieces to play games.

BACKGROUND OF THE INVENTION

It is well known for games to employ magnetic elements. Examples of such games include magnetic chess, checkers and backgammon games that use magnetic playing pieces to hold the pieces stationary and to prevent loss while playing in a moving vehicle. Other examples include magnetic toss games that use either magnetic targets or projectile-type magnetic game pieces that stick to targets made of magnetically attractive substances. Also known are magnetic tossing games that include targets affixed vertically to a wall so that magnetic projectile-type game pieces may be thrown at the vertical target in a manner similar to playing darts. The prior art also includes games that are similar to the well-known game hop-scotch in that magnetic projectile-type game pieces are thrown onto flat, horizontally-disposed floor targets.

Desirable additions to this art would include magnetic toss games with projectile-type game piece configurations that impart unique aerodynamic and magnetic-adhesive properties to the projectiles. Also desirable would be new game board or target configurations and methods and rules of play employing these new game piece and game board configurations.

SUMMARY OF THE INVENTION

A game piece device 22*a–h* comprising a base layer 24 of rubber multi-poled magnetic material, and an intermediate layer 26 bonded to an upper surface of the base layer 24. Characterizing the game piece device 22*a–b* is at least one aerodynamic appendage 58 that extends integrally outward from the intermediate layer 26 to alter the aerodynamic properties of the game piece device 22*a–d*.

Unlike prior art magnetic game pieces, a game piece constructed according to the present invention includes at least one aerodynamic appendage. The appendage changes the aerodynamic properties of the game piece to cause the game piece to fly farther or to otherwise modify the trajectory of the game piece.

BRIEF DESCRIPTION OF THE DRAWINGS

To better understand and appreciate the invention, refer to the following detailed description in connection with the accompanying drawings:

FIG. 1 is a perspective view of a game board constructed according to the invention;

FIG. 2 is a plan view of the game board of FIG. 1;

FIG. 3 is an exploded perspective view of a game piece constructed according to the invention;

FIG. 4 is a cross-sectional side view of the game piece of FIG. 3;

FIG. 5 is a top view of two game pieces constructed according to the invention;

FIG. 6 is a cross sectional side view of the game pieces of FIG. 5;

FIG. 7 is a perspective view of a game piece constructed according to the invention;

FIG. 8 is a perspective view of a game piece constructed according to the invention;

FIG. 9 is a perspective view of a game piece constructed according to the invention;

FIG. 10 is a perspective view of a game piece constructed according to the invention;

MAGNETIC TOSS GAME METHOD AND APPARATUS

DETAILED DESCRIPTION OF THE PREFERRED EMBODIMENT

The invention includes a plurality of game piece designs that are each intended for either projectile and non-projectile uses during play. Projectile-type game pieces are intended to be thrown toward a magnetically attractive playing surface. Non-projectile pieces are intended to serve some marking function such as to mark player advancement around a game board path.

A first projectile-type game piece is shown at 10 in FIGS. 5 and 6. Second, third, fourth, fifth, sixth, and seventh projectile-type game pieces are shown at 12, 14, 16, 18*a–c*, 20 and 22*a–h*, respectively, in FIGS. 1–15, 23, and 30*a–c*.

As best shown in FIGS. 3 and 4, the game pieces 10–16, 18*a–*18*c* and 20 each include a base layer of rubber multi-poled magnetic material 24, an intermediate layer 26 of paper, cardboard or the like, and an upper layer 28 providing a clear (transparent) polylaminate protective coating for the surface of the intermediate layer. The layers are held together in a well-known manner by any one of a number of suitable adhesives. The pieces may be constructed and used as described in U.S. patent application Ser. No. 08/389,288 filed Feb. 16, 1995 and incorporated herein by reference.

As is best shown in FIGS. 5 and 6, the first projectile-type game piece 10, comprises a center portion 36 surrounded by and supporting a plurality of flat, outwardly-radiating lobes 38. The lobes 38 extend integrally outward from the center portion 36 and have a thickness approximately equal to that of the center portion 36. The lobes 38 are more flexible than the outer rim of a disk of like thickness and diameter would be. The additional flexibility allows a larger portion of the game piece to adhere more readily to a magnetically-attractive surface, even when the 10 strikes the surface at an oblique angle. The flexible lobes 38 also allow the game piece 10 to adhere more readily when overlapping another projectile 12 that has previously been stuck on a game board. This is because the lobes 38 are able to flex independently and allow portions of the game piece 10 to overlap while other portions lie flush with the game board surface. However, the particular shape of the game shown at 10 in FIG. 5 is ornamental.

Four embodiments of a projectile-type game piece, of this invention indicated at 22*a–*22*d* in FIGS. 7–14, respectively. Each variant includes one of an aerodynamic structure attached via a thin adhesive layer to a flexible magnetic substrate 60. The substrate 60 is shown to be square in FIGS. 7 and 8 but may also be circular, oval or any other suitable shape. Whirligig versions, one example of which is shown at 22*b* in FIG. 8, include an airfoil piece 56 with one or more rotor blades 58 that cause the piece 22*b* to spin—creating a rotary wing effect and imparting a gyroscopic stabilizing effect. An overlay piece 62 may be bonded to an upper wing surface. Similarly, the embodiment, shown at 22*a* in FIG. 7, include one or more wings 58 bonded to a magnetic substrate 60 with an overlay piece 62 bonded to an upper wing surface. The overlay pieces 56 are shown as being square in FIGS. 7 and 8 but may, alternatively, be circular, oval or any other suitable shape. Assembly of these various pieces may be accomplished using jigs and pressure-sensitive adhesives. The projectile-type game pieces, 22*a*–22*d* are intended to be thrown against a magnetically-attractive surface such as a specially-designed game board or a refrigerator door. The rotors 58 may be folded upward, as shown in FIGS. 7 and 8, to keep them off the magnetically-receptive surface.

"Auto Racing" is a game that uses the game board 108 depicted in FIGS. 1 and 2, two projectile-type magnetic game pieces 12, and two non-projectile magnetic game pieces 232. The non-projectile pieces may be car-shaped as shown at 232 in FIG. 2. The players begin by placing their respective "car" pieces 232 behind the starting line 234, as shown. The players then take turns throwing their projectile-type game pieces 12 at the target 110. The player whose game piece 12 comes closest to the target 110 advances his or her car piece 232 to the next space along the race course. The player whose car piece 232 crosses the finish line 236 first, wins.

Each of the game piece embodiments illustrated in FIGS. 7 through 10 includes an aerodynamic body of thin sheet material having a base portion and at least one rotor having a fixed end joined to the peripheral edge of the base portion, and a free end, both of which are spaced radially from an axis that is normal to and passes through, the center of the base portion. A magnetic substrate is secured to the underside of the base portion such that it is adapted to engage and secure the game piece to, a magnetically attractive game surface.

The game piece 22*a* shown in FIG. 7 includes an aerodynamic body of thin sheet material having a base portion 56*a* and a single rotor 58*a*. The rotor 58*a* has a fixed end 57*a* joined to the periphery of the base portion of 56*a*. The rotor 58*a* is in the form of a flat blade that projects from the fixed end 57*a* to a free end 59*a* that the free end is spaced radially both from the fixed end and the central axis Y of the base portion. Axis Y is normal to the base portion 56*a* and passes through the center thereof.

The rotor 58*a* in FIG. 7 lies in a plane that is disposed at an acute angle x with respect to the plane of the lower surface of the base portion 56*a*. Consequently, the free end 59*a* is spaced upwardly from the underside of the base portion.

The rotor 58*a* has curved side edges 61*a* and 63*a* that are symmetrical with respect to the longitudinal axis of the rotor 58*a* that extends through the fixed end 57*a* and free end 59*a*.

The FIG. 8 embodiment includes an aerodynamic body 58*b* of thin sheet material having a pair of rotors each having a fixed end 57*b* joined to the periphery of the base portion 56*b*, and a free end 59*b*, spaced outwardly from the base portion and from the central axis of the base portion.

Each of the rotor blades has first and second side edges 61*b* and 63*b* extending between the fixed and free end. The width of the free end 59*b* is greater than the width at the fixed end 57*b*. A tab 65 projects from the side edge 64*b* adjacent to the free end 59*b*. The tab 65 is bent upwardly in FIG. 8 at an acute angle with respect to the undersides of the rotor blades.

The FIG. 9 embodiment has a triangular-shaped base portion 56*c* and three rotors 58*c*, each of which has a fixed end 57*c* joined to the periphery of the base portion, and a free end 59*c*. An arcuate edge portion passes through the free end 59*c* and is bisected by the longitudinal axis of the rotor blade.

The FIG. 10 embodiment includes a square base portion 56*d* and 4 rotor blades of stepped configuration each having a fixed end 57*d* joined to the periphery of the base portion, and a free end 59*d* that is spaced radially from the fixed end and the central axis Y of the base portion. The free end 59*d* is from the central axis Y a greater radial distance than the fixed end 57*d*. Each of the rotors has inner and outer horizontal segments connected by a vertical segment that is substantially parallel to the central axis Y of the base portion. Each of the rotors in FIG. 10 is of constant width throughout its length, and has first and second side edges that are parallel to each other, and are connected at the outer end by the flat free end 59*d*.

The inventor intends this to be an illustrative description of his invention employing descriptive rather than limiting words. There are many ways that one could modify or deviate from the described embodiments while remaining within the scope of the invention. In other words, many modifications and variations of this invention are possible in light of the above teachings and one may practice the invention other than as described.

What is claimed is:

1. A spinning-type game piece that can be tossed at, and secured to, a magnetically attractive game surface, said game piece comprising:

an aerodynamic body of thin sheet material, said body comprising:

a planar base portion, and at least one rotor;

said rotor having a fixed end joined to the periphery of said base portion, and a free end;

said fixed and free ends both being spaced radially from an axis that is normal to the plane of the base portion, and passes through the center of, said base portion;

said free end being spaced from said axis a greater radial distance than said fixed end;

and a magnetic substrate secured to an underside of said base portion such that said magnetic substrate is adapted to engage a magnetically attractive game surface and secure the game piece thereto.

2. A game piece as claimed in claim 1 in which said base portion is of non-circular configuration.

3. A game piece as claimed in claim 2 in which said base portion is of polygonal configuration.

4. A game piece as claimed in claim 1 in which said free end of said rotor is spaced upwardly from the underside of said base portion.

5. A game piece as claimed in claim 1 in which said rotor comprises a flat, planar, blade extending between said fixed and free ends.

6. A game piece as claimed in claim 5 in which said free end is spaced upwardly from the underside of said base portion such that said blade is disposed at an acute angle with respect thereto.

7. A game piece as claimed in claim 6 in which the width of said blade varies between said fixed and free ends.

8. A game piece as claimed in claim 7 in which the width of said blade at the free end is greater than the width at the fixed end.

9. A game piece as claimed in claim 8 in which the width of said blade decreases from the fixed end to the free end.

10. A game piece as claimed in claim 9 in which the free end of said blade is pointed.

11. A game piece as claimed in claim 1 in which the width of said blade is constant between said fixed and free ends.

12. A game piece as claimed in claim 5 in which said free end has an arcuate edge that is bisected by the longitudinal axis of said blade.

13. A game piece as claimed in claim 9 in which said base portion of polygonal configuration.

14. A game piece as claimed in claim 5 in which said blade has symmetrical, curved side edges extending between said fixed and free ends.

15. A game piece as claimed in claim 8 in which said flat blade has a tab that projects from one of said side edges adjacent to said free end.

16. A game piece as claimed in claim 15 in which said tab is bent upwardly with respect to a top surface of said flat blade.

17. A game piece as claimed in claim 1 in which said at-least-one-rotor comprises a pair of rotors each having its fixed end joined to an edge of said base portion.

18. A game piece as claimed in claim 17 in which said pair of rotors project from said base portion in opposite directions.

19. A game piece as claimed in claim 1 in which said base portion is of non-circular configuration.

20. A game piece as claimed in claim 18 in which said base portion is of polygonal configuration.

21. A game piece as claimed in claim 20 in which said base portion is of triangular configuration.

22. A game piece as claimed in claim 21 in which said at-least-one-rotor comprises three rotors, each of which has a fixed end joined to a respective edge of said triangular base portion.

23. A game piece as claimed in claim 1 in which said at-least-one-rotor comprises a single rotor.

24. A game piece as claimed in claim 1 in which said rotor is of stepped configuration between said fixed and free ends.

25. A game piece as claimed in claim 24 in which said rotor comprises a first segment projecting from said fixed end, a second segment projecting upwardly from an end of said first segment that is remote from said fixed end, and a third segment projecting outwardly of an upper end of said second segment and terminating at said free end.

26. A game piece as claimed in claim 1 in which said at-least-one-rotor comprises four rotors.

27. A game piece as claimed in claim 26 in which each of said rotors is of stepped configuration.

28. A game piece as claimed in claim 1 further including, in combination therewith, a game surface of magnetically attractive material.

* * * * *